US009719268B2

(12) United States Patent
Nieminski

(10) Patent No.: US 9,719,268 B2
(45) Date of Patent: Aug. 1, 2017

(54) VENTILATED ATHLETIC FLOORING SYSTEMS AND METHODS OF ASSEMBLING THE SAME

(71) Applicant: AACER Acquistion, LLC, Peshtigo, WI (US)

(72) Inventor: Jason Nieminski, Pound, WI (US)

(73) Assignee: AACER Acquisition, LLC, Peshtigo, WI (US)

( * ) Notice: Subject to any disclaimer, the term of this patent is extended or adjusted under 35 U.S.C. 154(b) by 463 days.

(21) Appl. No.: 13/841,225

(22) Filed: Mar. 15, 2013

(65) Prior Publication Data

US 2014/0260025 A1 Sep. 18, 2014

(51) Int. Cl.

| | |
|---|---|
| ***F24F 11/02*** | (2006.01) |
| ***E04H 3/10*** | (2006.01) |
| ***E04H 15/00*** | (2006.01) |
| ***E04F 15/22*** | (2006.01) |
| ***E01C 13/02*** | (2006.01) |
| ***F24F 7/00*** | (2006.01) |
| ***F24F 11/00*** | (2006.01) |
| *E04F 15/02* | (2006.01) |

(52) U.S. Cl.

CPC ..... *E04H 3/10* (2013.01); *E01C 13/02* (2013.01); *E04F 15/02044* (2013.01); *E04F 15/22* (2013.01); *E04F 15/225* (2013.01); *F24F 7/00* (2013.01); *F24F 11/0001* (2013.01); *F24F 11/001* (2013.01); *E04F 2015/02111* (2013.01); *F24F 2221/40* (2013.01)

(58) Field of Classification Search

CPC ..... F24F 5/10; F24F 2221/40
USPC ..... 52/263, 403.1, 480; 472/92; 454/186, 454/187; 236/49.3

See application file for complete search history.

(56) References Cited

U.S. PATENT DOCUMENTS

| | | | | |
|---|---|---|---|---|
| 4,443,989 | A | 4/1984 | Silvey et al. | |
| 4,877,182 | A | 10/1989 | Pugh et al. | |
| 5,253,804 | A | 10/1993 | Sarazen, Jr. et al. | |
| 5,299,401 | A | 4/1994 | Shelton | |
| 5,468,184 | A * | 11/1995 | Collier | 454/186 |
| 5,526,621 | A * | 6/1996 | Shelton | 52/302.1 |
| 5,954,046 | A * | 9/1999 | Wegler | 126/617 |
| 6,101,775 | A * | 8/2000 | Larimore | 52/302.1 |
| 6,279,279 | B1 * | 8/2001 | Larimore | 52/302.1 |
| 6,386,460 | B2 * | 5/2002 | Riley et al. | 236/49.3 |
| 6,557,314 | B2 | 5/2003 | Shelton | |
| 7,097,111 | B2 * | 8/2006 | Riley et al. | 236/49.3 |
| 7,640,760 | B2 * | 1/2010 | Bash et al. | 62/178 |

(Continued)

*Primary Examiner* — Robert Canfield
(74) *Attorney, Agent, or Firm* — Greenberg Traurig, LLP

(57) ABSTRACT

A ventilated flooring system may generally include a base, a substructure, a top surface, a control box, an air mover, and a sensor. The base, the substructure, and the top surface may form a floor within which the sensor is disposed. The sensor may measure properties of air within the floor, sending measurements to the control box. The control box may activate and deactivate the air mover based on measurements from the sensor and control logic. In some examples, the air mover is connected to an HVAC system and routes air output from the HVAC system into the floor. Further, the ventilated flooring system may also include a second sensor for measuring ambient air, an alarm for providing notice of malfunctions, and/or networking capability that allows for remote monitoring of the system.

20 Claims, 8 Drawing Sheets

(56) References Cited

U.S. PATENT DOCUMENTS

| | | | | |
|---|---|---|---|---|
| 8,229,597 | B2 * | 7/2012 | Burton | 700/276 |
| 8,640,479 | B2 * | 2/2014 | Bettella | 62/259.2 |
| 2008/0311842 | A1 * | 12/2008 | Alston et al. | 454/361 |
| 2009/0108082 | A1 * | 4/2009 | Goldmann et al. | 236/49.1 |
| 2009/0203306 | A1 * | 8/2009 | Sugata | 454/234 |
| 2010/0102136 | A1 * | 4/2010 | Hadzidedic et al. | 236/49.3 |
| 2010/0102137 | A1 * | 4/2010 | Plini | 236/44 C |
| 2010/0186305 | A1 | 7/2010 | Larimore | |
| 2010/0273412 | A1 * | 10/2010 | Will | 454/173 |
| 2010/0286831 | A1 * | 11/2010 | Boudreau et al. | 700/278 |

* cited by examiner

VENTILATED ATHLETIC FLOORING SYSTEMS AND METHODS OF ASSEMBLING THE SAME

FIELD OF THE INVENTION

This disclosure relates to flooring systems and, more particularly, to ventilated athletic flooring systems and methods of assembling such flooring systems.

BACKGROUND

Traditionally, wood has been the preferred material for athletic floors for indoor athletic venues such as gymnasiums, racquetball courts, and the like. The structure of such flooring systems can generally be described as having a base typically of concrete, a middle layer of structures typically referred to as a substructure, and a top surface of wood flooring. Just as the sophistication of athletics has grown over the years, so too has the design of these substructures for athletic floors, as the substructures of athletic floors contribute significantly to the physical properties of the finished athletic floor.

Further, athletic floors are frequently installed in venues that lack sufficient environmental controls. Maintaining air quality, such as air having a particular temperature, humidity, and carbon dioxide content, for example, may be necessary to maintain stability in these athletic flooring systems. Many substructures include fixed sleepers that create a multiplicity of discrete air ducts beneath the top surface. To ventilate the flooring systems, an air mover that extends along one side of the flooring venue moves air through the discrete air ducts beneath the floor. To date, however, such flooring systems are unreliable because the air moved through these flooring systems may have qualities preferable to the air that is already present in the flooring systems. Moreover, properties of ambient air that is external to flooring systems can vary with the seasons, the weather, the time of day, or the number of people occupying a building.

DETAILED DESCRIPTION

Figure 1:
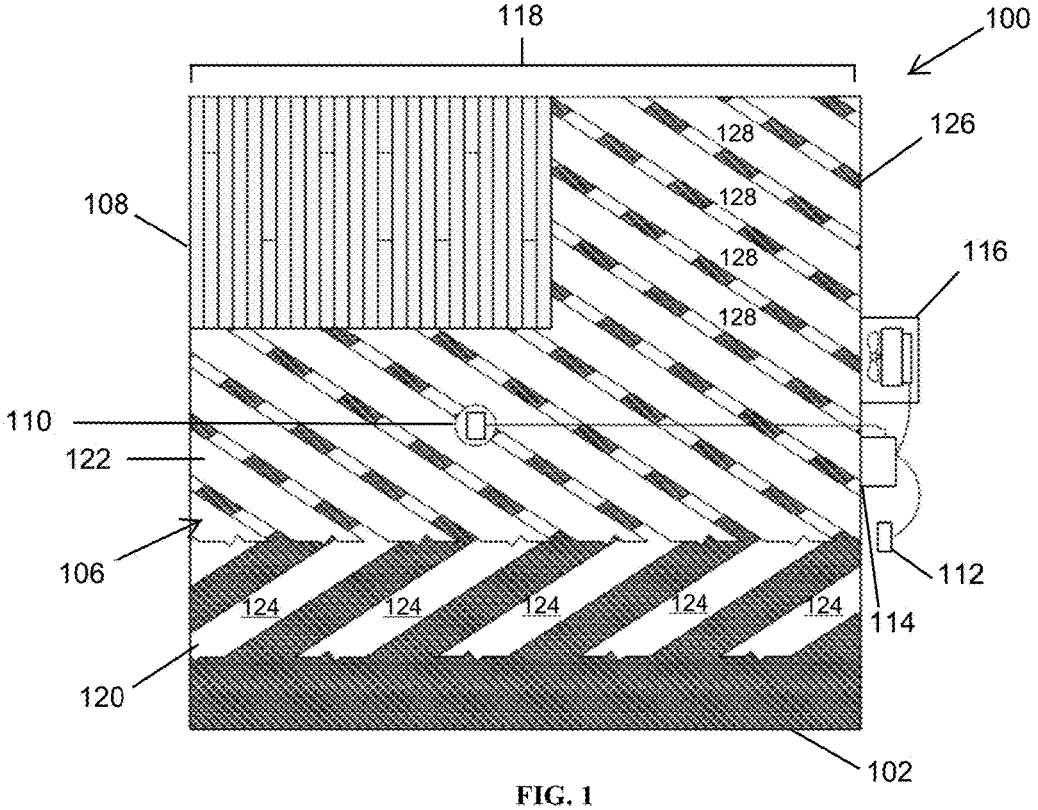
FIG. 1 is a partially sectioned fragmentary plan view of an example flooring system of this disclosure.

In general, the following disclosure concerns a ventilated flooring system that may in some examples include a base, a substructure, a top surface, a control box, an air mover, and a sensor. In many examples, the flooring system may pertain to an athletic ventilated flooring system. In other examples, though, the flooring system could pertain to other types of floors such as, for example and without limitation, performance floors, stage floors, museum floors, retail floors, and/or the like. The base, which is typically formed of asphalt or concrete, may support the substructure that contains a plurality of voids or other spaces through which air can pass. The substructure may be comprised of one, two, or more subfloors. In turn, the substructure may support the top surface of flooring. The base, the substructure, and the top surface may be referred to as an athletic floor.

Further, one or more sensors may be disposed within the athletic floor and, in many examples, within the voids of the substructure. In examples where the substructure includes a pad, the sensors may also or alternatively be disposed on or within the pad. Nonetheless, each sensor may measure properties of air within the athletic floor, such as carbon dioxide content, humidity, smoke, and temperature. These measurements may be transmitted to the control box, either by wire or wirelessly. The control box may activate and deactivate the air mover or air movers based on measurements from the sensor and control logic. In some examples, the control logic may involve comparing the measurements to a target range for one or more of the properties of air. In other examples where more than one sensor is used, the control logic may involve comparing the quality of air within the athletic floor to the quality of ambient air that is selectively moved into the athletic floor.

In some examples, the air mover may be connected to an HVAC system such that the air mover directs air that is output from the HVAC system into the athletic floor. Still further, the ventilated athletic flooring system may also include an alarm for providing notice of malfunctions or unfavorable air qualities. The ventilated athletic flooring system may yet further include the capability to connect to a network such that the system may be remotely monitored.

The following description of example systems and methods is not intended to limit the scope of disclosure to the precise form or forms detailed herein. Rather, the following description is intended to be illustrative so that others may follow its teachings. Further, in the drawings where like numbers refer to like objects, the proportions of some elements have been modified to facilitate illustration.

Figure 2:
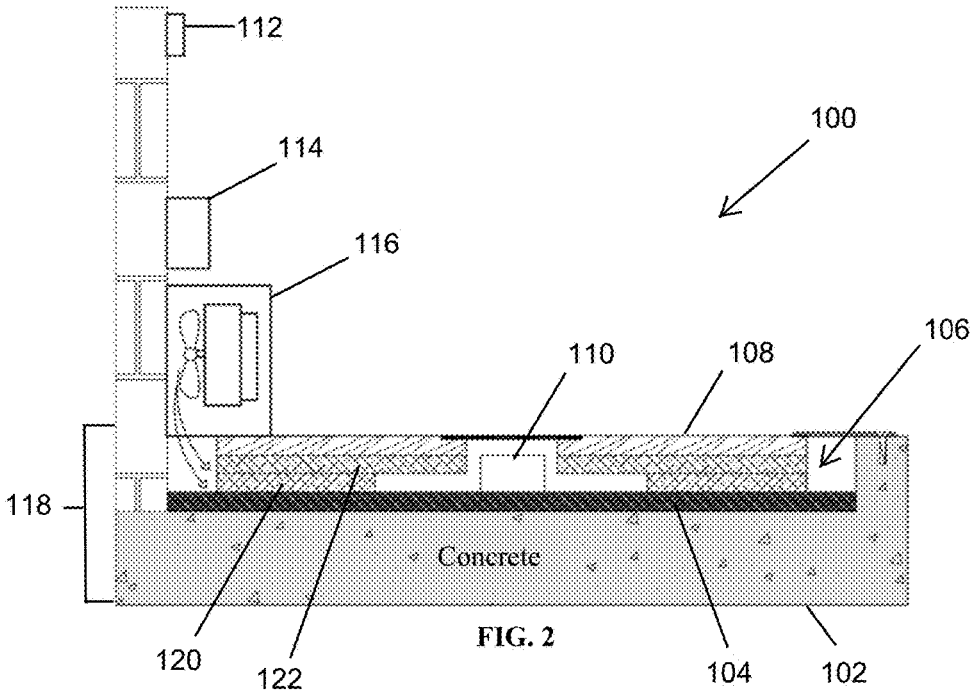
FIG. 2 is a sectioned elevational view of the flooring system of FIG. 1.

With reference now to FIGS. 1 and 2, an example ventilated athletic flooring system 100 generally includes a base 102, a pad 104, a substructure 106, a top surface 108, at least two sensors 110, 112, a control box 114, and at least one air mover 116. The base 102, the pad 104, the substructure 106, and the top surface 108, collectively, may be referred to as an athletic floor 118. Before describing the control box 114 and operation of the athletic flooring system 100, the structure of the athletic floor 118 will be described.

The base 102, which is typically formed of concrete or asphalt, may support one or more pads 104 that rest upon the base 102. While pads are common elements in modern high performance athletic floors, the ventilated athletic flooring system 100 can be constructed without the presence of pads. Nonetheless, the example pad 104 shown in FIG. 2 may be formed of closed cell synthetic resilient foam material, such as polyethylene foam, or a number of other composite materials that those of ordinary skill in the art will appreciate. In one example, the pad 104 may be up to three-fourths of an inch thick. Further, the pad 104 may be breathable and/or may contain pores, channels, chambers, conduits, detents, ribs, and/or the like along or through which air can pass.

The substructure 106 may be formed of at least one subfloor. The example substructure 106 shown in FIGS. 1-2 includes a first subfloor 120 and a second subfloor 122. The example first subfloor 120 rests on the pad 104 and may be formed of boards 124 made of spruce-pine-fir (SPF). The boards 124 may be laid at an angle to an outside edge 126 of the athletic floor 118, and extending thereto. The boards 124 in one example are laid parallel to each other and spaced apart from each other as shown. In some examples, these boards 124 may be spaced between one and twelve inches apart, running parallel to one another so as to cover the pad 104 and/or the base 102.

The example second subfloor 122 rests upon the first subfloor 120 and may likewise be formed of boards 128 of SPF. The boards 128 of the second subfloor 122 may be laid at an angle with respect to the outside edge 126 of the athletic floor 118. The boards 128 may be laid parallel to each other and spaced apart from each other as shown. Similar to the boards 124 of the first subfloor 120, the boards 128 of the second subfloor 122 can be spaced in some examples between one and twelve inches apart, though not necessarily spaced the same distance apart as the board 124 of the first subfloor 120. For example, spacing the boards 128 of the second subfloor 122 closer together than the boards 124 of the first subfloor 120 can improve physical properties of the athletic floor. The boards 128 of the second subfloor 122 may cross the boards 124 of the first subfloor 120 at an angle as shown. In still other examples, however, the boards 128 of the second subfloor 122 may cross the boards 124 of the first subfloor 120 at a different angle, such as at 90 degrees or at 120 degrees, for example and without limitation. Further, the top floor 108, which is supported by the second subfloor 122 in the example in FIGS. 1-2, may be formed of a quality hardwood such as hard maple, for instance.

Although in many examples the boards 124, 128 are comprised of wood, the boards 124, 128 can be formed of a wide variety of materials including composite materials. In some examples the first and second subfloors 120, 122 are formed of the same material, while in other examples the first and second subfloors 120, 122 may be formed of different materials. Likewise, components of the first subfloor 120 may be the same size or may be a different size than components of the second subfloor 122. Further, board widths typically, though not necessarily, range from two inches to twelve inches.

Figure 3:
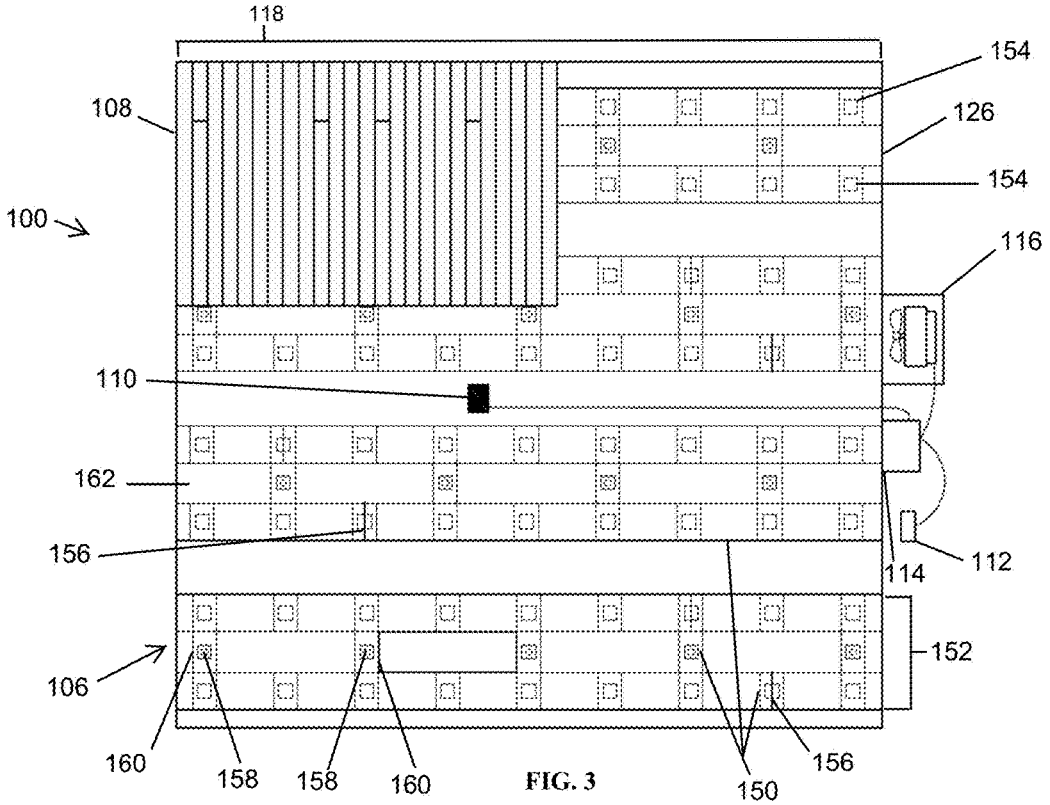
FIG. 3 is a partially sectioned fragmentary plan view of another example flooring system of this disclosure.
Figure 4:
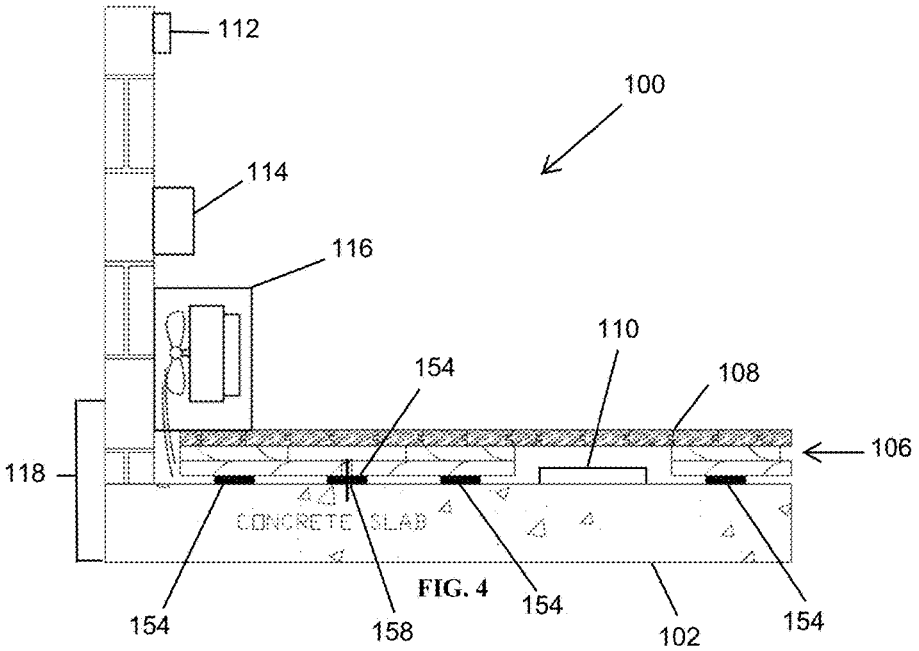
FIG. 4 is a sectioned elevational view of the flooring system of FIG. 3.

FIGS. 3-4 show the ventilated athletic flooring system 100 using another example substructure 106. The example substructure 106 may comprise a combination of nominal 1"×6", 1"×4", 1"×10", 1"×12" boards 150 or nominal ½"×6", ½"×4", ½"×10", ½"×12" boards 150, for instance, that form panels 152 having a ladder-like design. The example substructure 106 and its ladder-like panels 152 are shown and described more fully in U.S. Pat. No. 6,557,314 to Shelton, entitled, "ATHLETIC FLOORING SUBSTRUCTURE," which is hereby incorporated by reference in its entirety. Similar to the example substructure 106 shown in FIGS. 1-2 and described above, the example substructure 106 of FIGS. 3-4 can be laid over the base 102, with or without the pad 104. In addition, the boards 150 of the substructure 106 may be laid perpendicular to or at an angle to the edge 126 of the athletic floor 118. To provide resiliency in the athletic floor 118, the panels 152 may comprise resilient pads 154 or foam disposed between the base 102 and the panels 152 and/or between the boards 150 forming the panels 152. The resilient pads 154 may in some examples be one half-inch thick, four inches by four inches, hydrophobic, and formed of natural rubber, neoprene, urethane foam, or the like.

In one example, to allow the panels 152 to be assembled adjacent to and in connection with one another, the panels 152 may have overlapping ends 156. Further, to prevent buckling of the boards 150 of the panels 152 in times of expansion, the boards 150 may be spaced lengthwise at least a quarter-inch apart. Thus, although hard to see, the boards 150 at the overlapping ends 156 may have at least a quarter-inch gap between them. Still further, the boards 150 of the panels 152 may be spaced widthwise from a quarter-inch to fifteen inches apart from one another. The panels 152 could then be either anchored to the substrate or left "floating."

Those having ordinary skill in the art will appreciate that one example advantage of using the panels 152 for the substructure 106 of the ventilated athletic flooring system 100 is that the panels 152 may be assembled at a location remote from an installation venue. The panels 152 can then be rapidly installed at the venue by securing anchors 158 affixed to anchor strips 160 of the panels 152 to the base 102. Some of the anchors 158 may penetrate through one or more of the resilient pads 154. Once the panels 152 are installed at the venue, the top surface 108 may then be secured to the panels 152 to complete the athletic floor 118. The panels 152 may create volumes 162 wherein there are no boards 150 between the base 102 and the top surface 108. As described below, the volumes 162 provide channels through which ventilating air can flow.

Figure 5:
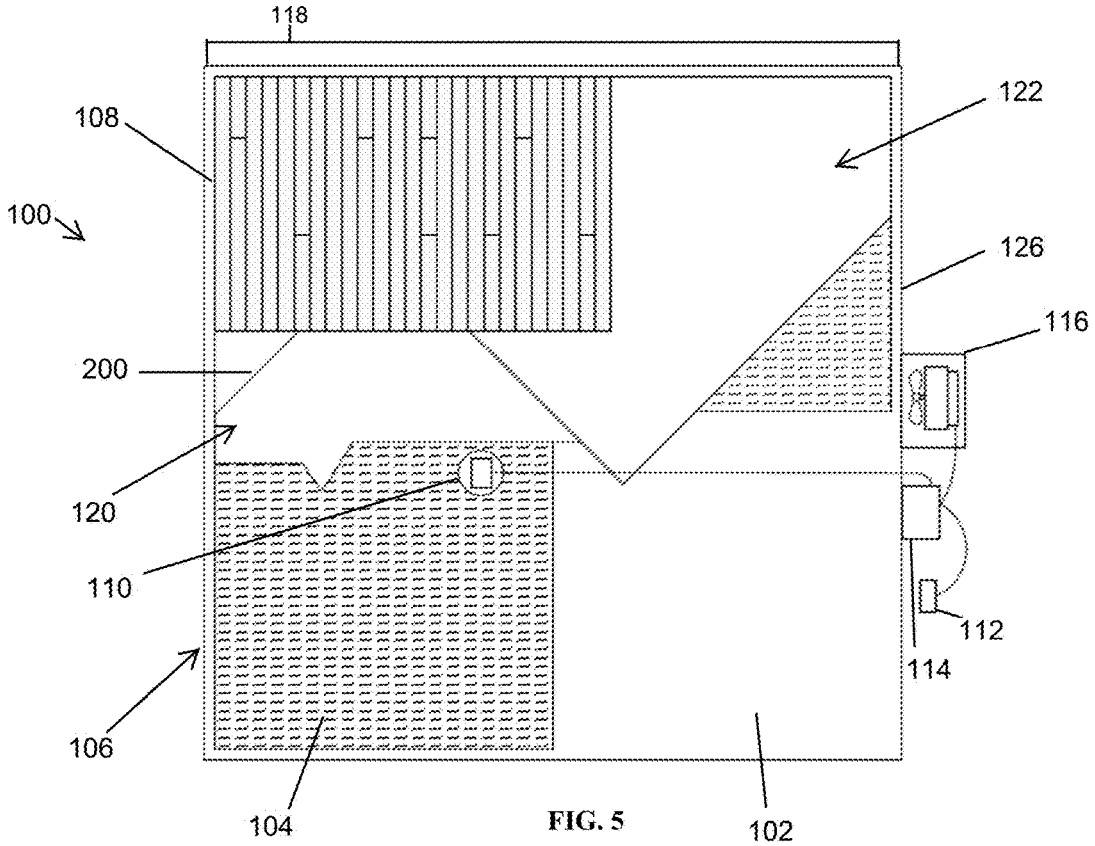
FIG. 5 is a partially sectioned fragmentary plan view of still another example flooring system of this disclosure.
Figure 6:
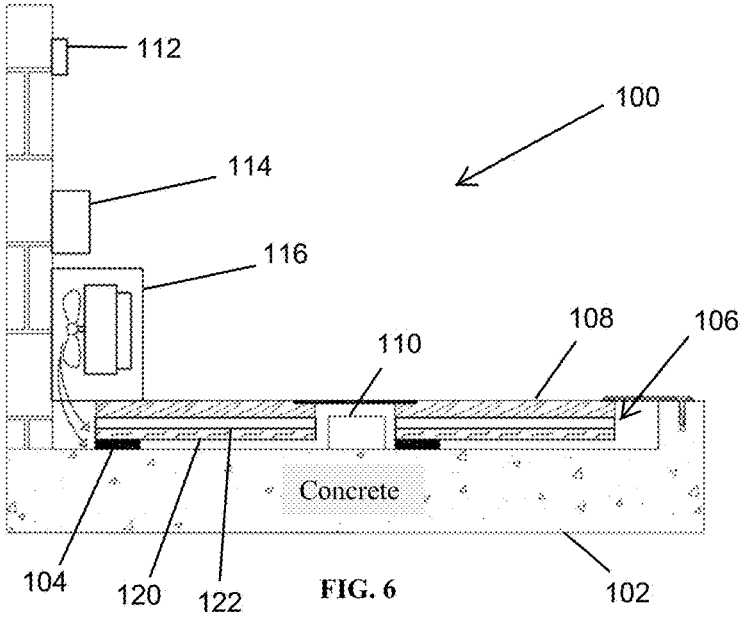
FIG. 6 is a sectioned elevational view of the flooring system of FIG. 5.
Figure 7A:
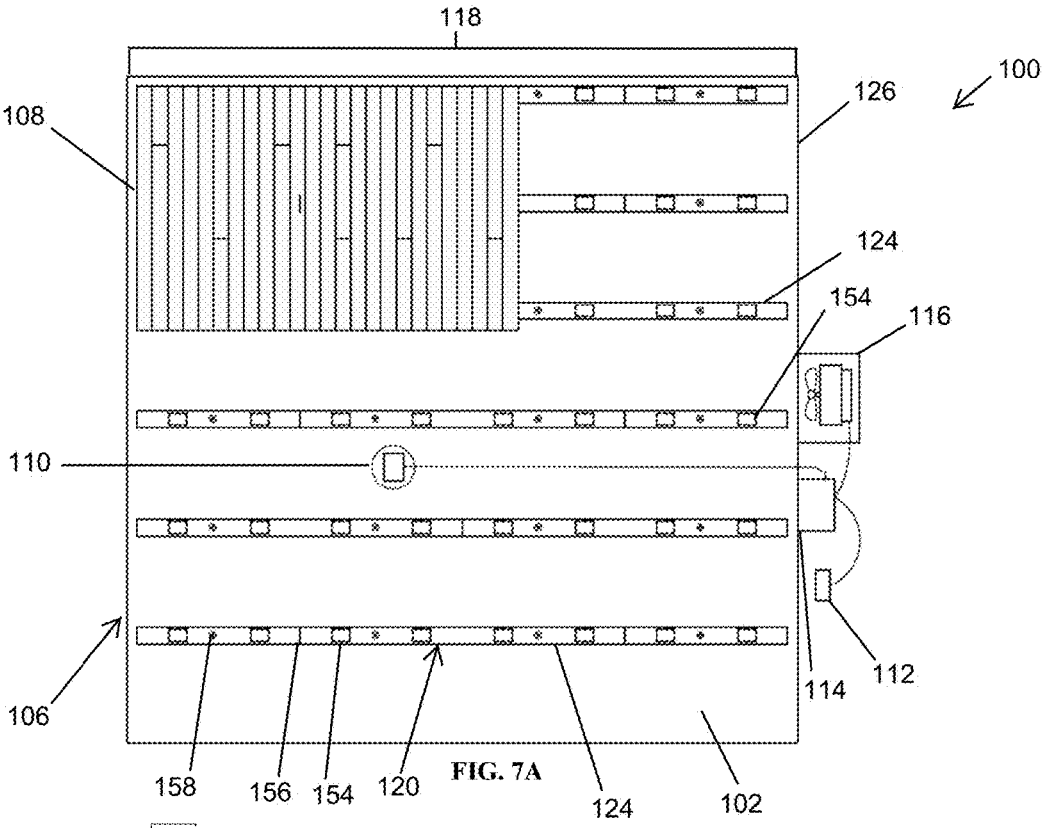
FIG. 7A is a partially sectioned fragmentary plan view of yet another example flooring system of this disclosure.
Figure 8A:
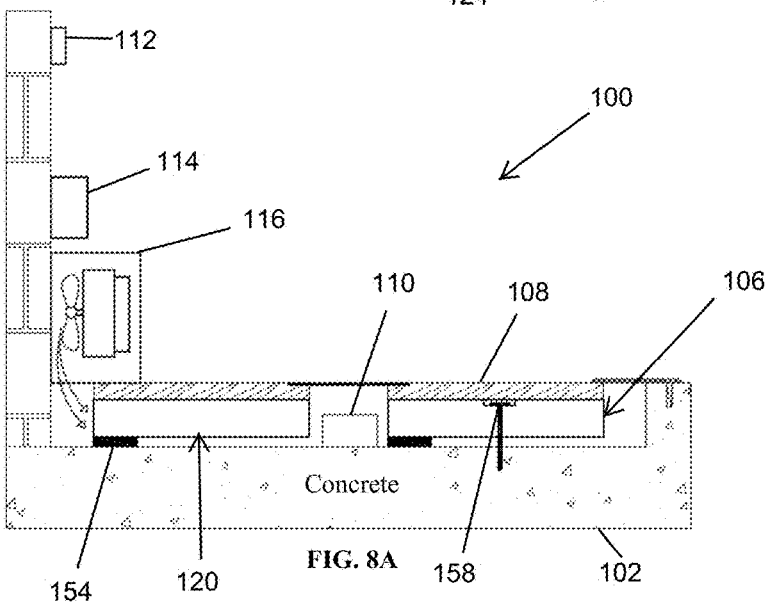
FIG. 8A is a sectioned elevational view of the flooring system of FIG. 7A.
Figure 7B:
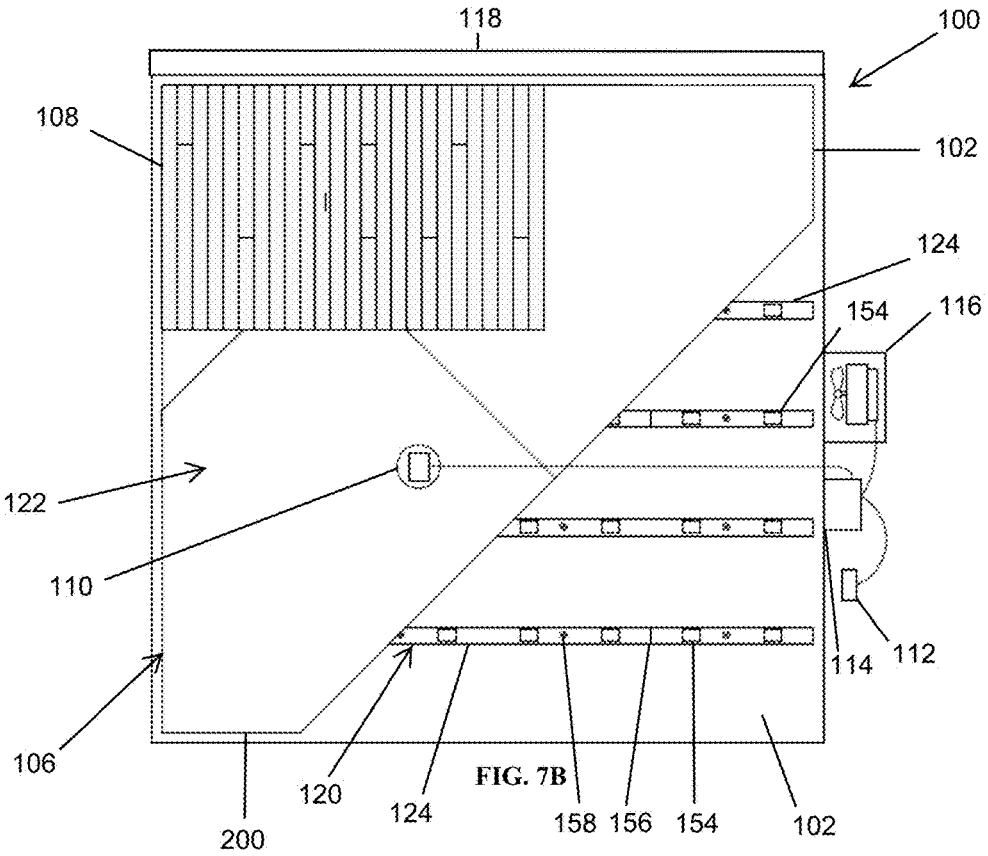
FIG. 7B is a partially sectioned fragmentary plan view of another example flooring system of this disclosure.
Figure 8B:
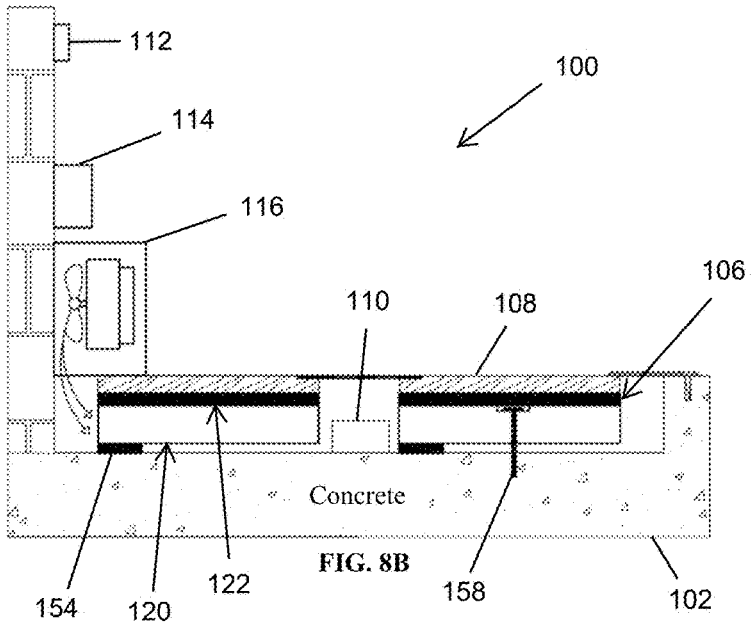
FIG. 8B is a sectioned elevational view of the flooring system of FIG. 7B.

Turning now to FIGS. 5-6, still another example substructure 106 includes the first and second subfloors 120, 122 as shown in partial cutaway. It will be understood by those having ordinary skill in the art that the substructure 106 may include one, two, three, four, or even more subfloors. That said, each of the subfloors 120, 122 may include, for example, a layer of plywood 200 ranging in thickness from ¼", ⅜", ½", ⅝", ¾" to 3". In one example, the plywood 200 may be CDX plywood. The substructure 106 may also include the resilient pads or foam (not shown), as described above, which can be attached to the first subfloor 120 of plywood 200, the second subfloor 122 of plywood 200, and/or other floors if the substructure 106 includes multiple subfloors. Thus in this example, the resilient pads may be disposed between the first and second subfloors 120, 122 and/or between the base 102 and the first subfloor 120. The one or more layers of plywood 200 may be glued, screwed, and/or stapled to one another or to the pad 104. Alternatively, if the substructure 106 includes only one subfloor of plywood 200, the top surface 108 may contact or may be attached to the layer of plywood 200 of the first subfloor 120. However, if the second subfloor 122 of plywood 200 is used, the second subfloor 122 can be arranged on an angle to or perpendicular to the direction of the top surface 108. In general, any additional subfloors may be arranged in a different direction to the subfloor below it and/or generally perpendicular to the direction of the top surface 108.

In the alternative or in addition, the substructure 106 may include the pad 104 supported by the base 102, which may comprise concrete or asphalt, for instance. As shown in FIG. 5, the pad 104 need not necessarily cover the entire base 102. Rather, segments of the pad 104 may be laid on the base 102. Further, the first subfloor 120 may be laid either perpendicular to, parallel to, or at an angle to the edge 126 of the ventilated athletic flooring system.

In some examples where one or more layers of plywood 200 are used, the pieces of plywood may be spaced apart from one another so as to create channels through which air can travel. As described above, moreover, the pad 104 may have a design that allows air to travel along or through the pad 104. Further, the resilient pads or foam may also help create space between the layers of plywood 200 through which air can travel. Still further, the plywood 200 may have grooves, channels, and/or the like that allow for the passage of air and/or receiving the sensor 110. Thus even with the example substructure 106 shown in FIGS. 5-6, air can circulate through the substructure 106. Yet further, the sensor 110 used with substructures having layers of plywood can be located in any one of these passages along or through which air can circulate, including along or within the pad 104.

Still another example substructure 106 is shown in FIGS. 7A-8A. The example substructure 106 is a sleeper design, as those having ordinary skill in the art will understand, with a first subfloor 120. The boards 124 of the first subfloor 120 may be SPF 1"×2", 1"×3", 1"×4", 1"×5", 1"×6", 1"×7", 1"×8", 1"×10", 1"×12", 2"×3" or 2"×4" sleepers. In the example shown, the substructure 106 uses resilient pads 154 attached to the sleepers. In other examples, though, the substructure 106 does not utilize the resilient pads 154. Further, this example substructure 106 may be installed on and anchored to the base 102. The substructure 106 may be anchored to the base 102 with anchors 158, as described above. The example boards 124, which are used as sleepers in this example, may be laid perpendicular to the direction of the top surface 108 of the athletic floor 118. The sleepers can be spaced, for instance, from one inch on center (OC) to forty-eight inches OC. Further yet, the boards 124 of the first subfloor 120 may run either parallel to, perpendicular to, or at an angle to the edge 126 of the athletic flooring 118.

With reference now to FIGS. 7B-8B, yet another example substructure 106 comprises a base 102, a first subfloor 120, and a second subfloor 122. This example substructure 106 may be similar to the substructure 106 shown in FIGS. 7A-8A, except that the substructure 106 of FIGS. 7B-8B includes the second subfloor 122. The example first subfloor 120 may include SPF 1"×2", 1"×3", 1"×4", 1"×5", 1"×6", 1"×7", 1"×8", 1"×10", 1"×12", 2"×3" or 2"×4" boards 124, for example. In the example shown, the substructure 106 uses the resilient pads 154 between the boards 124 and the base 102. The resilient pads 154 may be attached to the boards 124. In other examples, however, the substructure 106 does not utilize the resilient pads 154. Here, the example second subfloor 122 comprises a layer of plywood 200 that is supported by the first subfloor 120. The second subfloor 122 may be laid onto the first subfloor 120 at an angle to, parallel to, or perpendicular to the boards 124 of the first subfloor 120. In addition or in the alternative, the layer of plywood 200 can be glued, screwed, and/or stapled to the first subfloor 120. As shown, the top floor 108 can be secured to the layers of plywood of the second subfloor 122.

Figure 9:
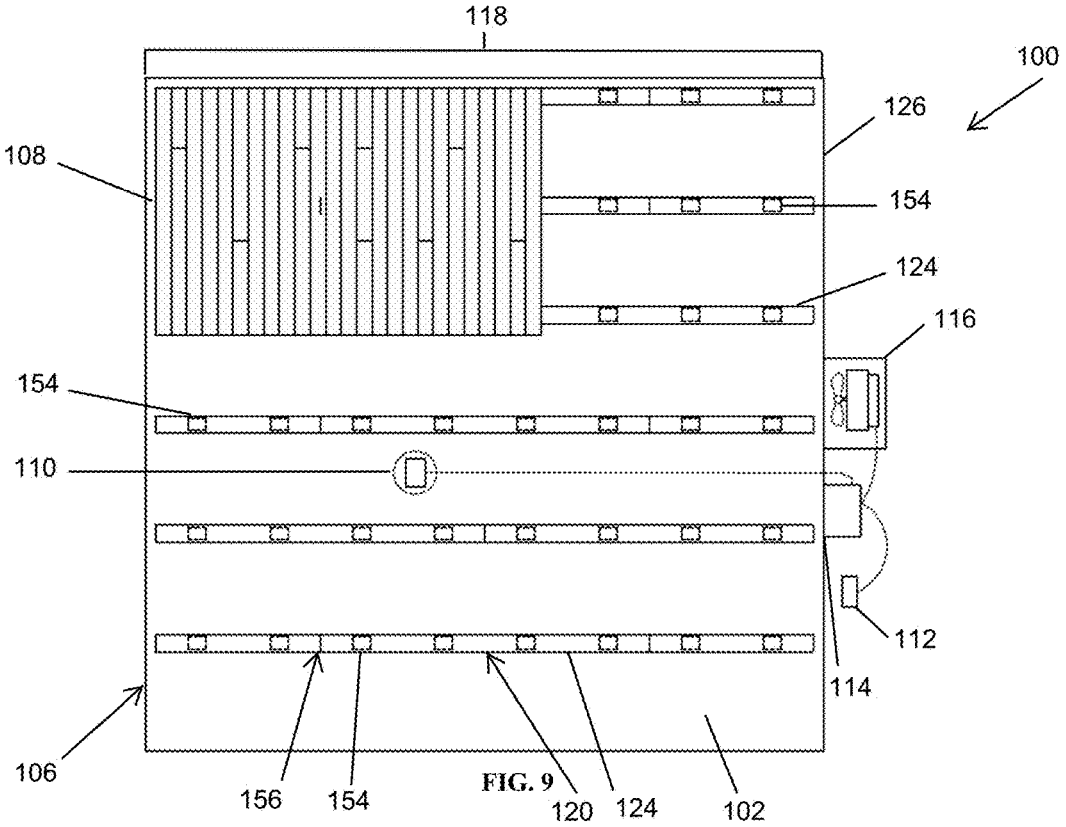
FIG. 9 is a partially sectioned fragmentary plan view of an example flooring system of this disclosure.
Figure 10:
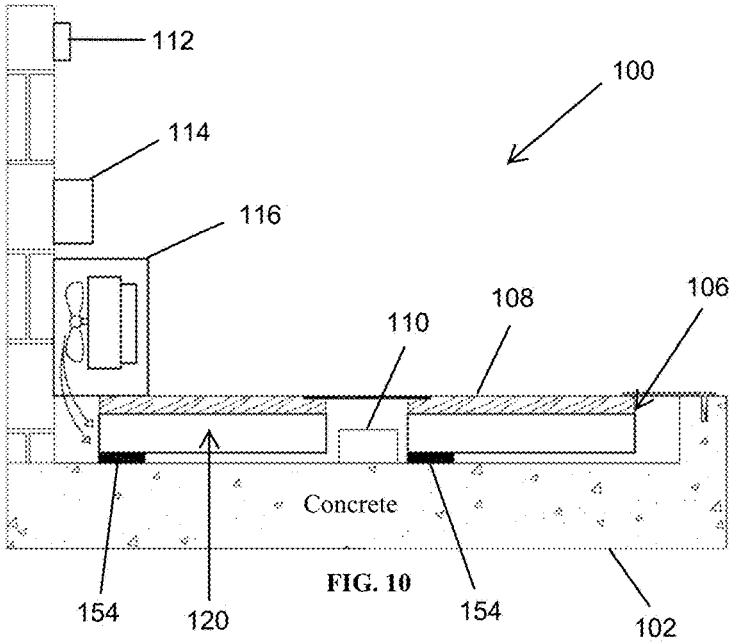
FIG. 10 is a sectioned elevational view of the flooring system of FIG. 9.

Still another substructure 106 is shown in FIGS. 9-10. This example substructure 106 is similar to the substructure of FIGS. 7A-8A, except that the substructure 106 of FIGS. 9-10 is not anchored to the base 102. This type of substructure 106 is said to be a "floating" substructure, rather than an "anchored" substructure.

While certain substructures have been described, it should be understood that these substructures are merely examples and do not limit the scope of this disclosure in any way. For example, any of the substructures or athletic floors shown or described in U.S. Pat. No. 5,299,401 to Shelton, entitled, "ATHLETIC FLOORING SYSTEM," which is hereby incorporated by reference in its entirety or U.S. Pat. No. 5,526,621 to Shelton, entitled, "VENTILATED ATHLETIC FLOORING SYSTEM," which also is hereby incorporated by reference in its entirety, could also be used as part of the ventilated athletic flooring system 100. Likewise, virtually any feature or characteristic of one of these example substructures may be equally applicable to the other substructures.

The example substructures 106 described above create a plurality or labyrinth of voids closed at the top by the top floor 108 and closed at the bottom by the base 102. In some examples, the voids may be channels, passages, conduits, volumes, or other spaces within the substructure 106 that are not occupied by boards or other solids. In many venues, the outside edges 126 of the athletic floors 118 do not closely abut the walls of the venue and permit the ready movement of air into and out of the substructure 106. In other venues, though, accommodations may be made so that air may be moved into and out of the labyrinth of voids. To maintain the quality of air within the labyrinth of voids, ambient air may be routed into the labyrinth by one or more air movers, such as the air mover 116 shown schematically in the figures. The quality of air may refer to one or more properties of air such as temperature, humidity, or carbon dioxide content, for example. The air movers 116, which in some examples may be located within the athletic floor 118, partially within the athletic floor 118, or along one or more sides of the athletic floor 118, can ventilate the athletic floor 118 by drawing in ambient air in and discharging the ambient air into the labyrinth of voids between the top floor 108 and the base 102. Moreover, the air movers 116 may utilize ducts in some examples to move air through the substructure 106. Ducts, which may be made from a variety of different types of materials, may be advantageous, for instance, where the air movers 116 are not disposed within the athletic floor 118 or directly alongside the athletic floor 118. In some examples, the ducts may extend through at least a portion of the athletic floor 118.

Also, the air may be discharged from the substructure 106, for example, through gaps in the perimeter of the athletic floor 118 or other vents. Selective air circulation, as described more below, is sufficient to maintain the air quality in the athletic floor 118 within acceptable limits. In one example, the air movers 116 are of the fan and duct type. The air movers 116 can have a length less than the length of the edge 126 of the flooring system 1, for instance, less than a fourth of the length of the edge 126 of the athletic floor 118.

Further, as described below, the control box 114 may selectively activate one or more of the air movers 116 based at least in part on comparisons of the air quality within the substructure 106 to the air quality of ambient air. In some examples, ambient air may refer to air in the room in which the athletic floor 118 is installed. More generally, though, ambient air may refer to air in virtually any location external to the substructure 106.

As shown in the figures, at least one sensor 110 is disposed within the labyrinth of voids in the athletic floor 118. This sensor 110 can measure the air quality in the voids in the substructure 106. Although FIGS. 2, 4, 6, 8A, 8B, and 10 show this sensor 110 to be relatively large and disposed within a relatively large gap within the substructure 106, this sensor 110 may in fact be relatively small, in the order of a fraction of an inch. Likewise, the gap in the substructure 106 in FIGS. 2, 4, 6, 8A, 8B, and 10, is only shown for purposes of illustration. However, in many examples, the sensor 110 located within the substructure 106 is assembled after the entire athletic floor 118 is installed. Those installing the athletic floor 118 may mark a spot on the top surface 108 under which wires, if any, terminate for the sensor 110. A hole may be created in the top surface 108 that provides access to the location that receives the sensor 110 and/or to the sensor 110 once installed. A small removable plate, for example, may be positioned to selectively cover this hole.

In addition and as also shown in the figures, at least one sensor 112 external to the substructure 106 can measure the air quality of ambient air. In one example, the sensors 110, 112, which in some examples are disposed in a membrane, may be industrial grade sensors that have reliable accuracy in lower ranges of humidity measurement. At least one of the sensors 110 is sized to fit in the voids of the athletic floor 118. Furthermore, the sensors 110, 112 may be configured to transmit measurements to the control box 114 continuously or periodically (e.g., every thirty seconds, every two minutes, or every fifteen minutes). In one example, the sensors 110, 112 may be wired to the control box 114. In other examples, however, the sensors 110, 112 may communicate wirelessly with the control box 114. For instance, each sensor 110, 112 and the control box 114 may contain a transceiver that allows the sensors 110, 112 to exchange data with the control box 114. The transceivers may utilize protocols such as Wi-Fi, Zigbee, Bluetooth, proprietary protocols, or any other wireless protocol, for example.

It will be appreciated by one having ordinary skill that the ventilated athletic flooring system 100 is not limited to the figures. For example, although only one sensor 110 is shown to be disposed within the labyrinth of voids, the present disclosure contemplates having two or more sensors disposed within the substructure 106. Likewise, two or more sensors, similar to the sensor 112, can be designated for measuring properties of the ambient air. Still further, the number of air movers 116 may vary as well. By way of example, the athletic floor 118 may include four sensors disposed throughout the labyrinth of voids, four air movers disposed at edges of the athletic floor, and four sensors disposed near intakes of the four air movers. Thus the control box 116 may selectively activate one or more of the air movers depending on air quality at the location of each respective sensor. Still another example ventilated athletic flooring system 100 may include only one sensor, which is disposed within the substructure 106.

In addition, the control box 114 may include a computing device having one or more processing units and a memory, which may be linked via a memory bus, a peripheral bus, a local bus, or any other type of bus using any of a variety of bus architectures. The example memory may include read only memory (ROM) and/or random access memory (RAM). Additional memory devices may also be made accessible to the computing device by means of, for example, a hard disk drive interface, a removable magnetic disk drive interface, and/or an optical disk drive interface. As will be understood, these devices allow for reading from and writing to a hard disk, reading from or writing to a removable magnetic disk, and for reading from or writing to a removable optical disk, such as a CD/DVD ROM or other optical media. The drive interfaces and their associated tangible, computer-readable media allow for the nonvolatile storage of computer readable instructions, data structures, program modules, and other data for the computing device. Those having ordinary skill in the art will further appreciate that other types of tangible, computer readable media that can store data may be used for this same purpose. Examples of such media devices include, but are not limited to, magnetic cassettes, flash memory cards, digital videodisks, Bernoulli cartridges, random access memories, nano-drives, memory sticks, and other read/write and/or read-only memories.

A number of program modules that facilitate operation of the ventilated athletic flooring system 100 may be stored in one or more of the memory/media devices. For example, a basic input/output system (BIOS) containing the basic routines that help to transfer information between elements within the computing device, such as during start-up, may be stored in the ROM. Similarly, the RAM, the hard drive, and/or peripheral memory devices may be used to store computer executable instructions comprising an operating system, one or more applications programs, other program modules, and/or program data that pertain to the ventilated athletic flooring system 100. Still further, computer-executable instructions may be downloaded to the computing device as needed, for example, via a connection to a network of the venue where the ventilated athletic flooring system 100 is located.

Those in charge of the ventilated athletic flooring system 100 may use the control box 114 to enter commands and information into the computing device through input devices such as a keyboard, a microphone, a joystick, a touchpad, a touch screen, a graphical user interface (GUI), a motion sensing input, or other similar devices. These and other input devices would typically be connected to the processing unit by means of an interface which, in turn, would be coupled to the bus. The input devices may be connected to the processor using interfaces such as, for example, a parallel port, game port, firewire, universal serial bus (USB), or the like. To receive information from the computing device, a monitor or other type of display device may also be connected to the bus via an interface, such as a video adapter. In addition to the monitor, the computing device may also include other peripheral output devices such as a speaker and light-emitting diodes (LEDs).

In still other examples, however, the control box 116 may not have an input device where those in charge of the ventilated athletic flooring system 100 can enter user input. For instance, in some examples, the only way to enter user input and modify settings may be to log in through the venue's system or through an online interface, for example and without limitation.

Amongst other functions, the control box 116 receives measurements from the sensors 110, 112 disposed both within the athletic floor 118 and external to the athletic floor 118. By comparing the air quality within the athletic floor 118 to the air quality of ambient air, the control box 114 can selectively activate one or more of the air movers 116 as needed. As described with reference to FIG. 11 below, the control box 114 may be configured with control logic that dictates when to activate the air movers 114 based on measurements from the sensors 110, 112. In some examples, some if not all aspects of the control logic may be modified by those in charge of the ventilated athletic flooring system 100. For example, settings for the ventilated athletic flooring system 100 may involve levels of air quality at which the air movers should be activated and deactivated.

Figure 11:
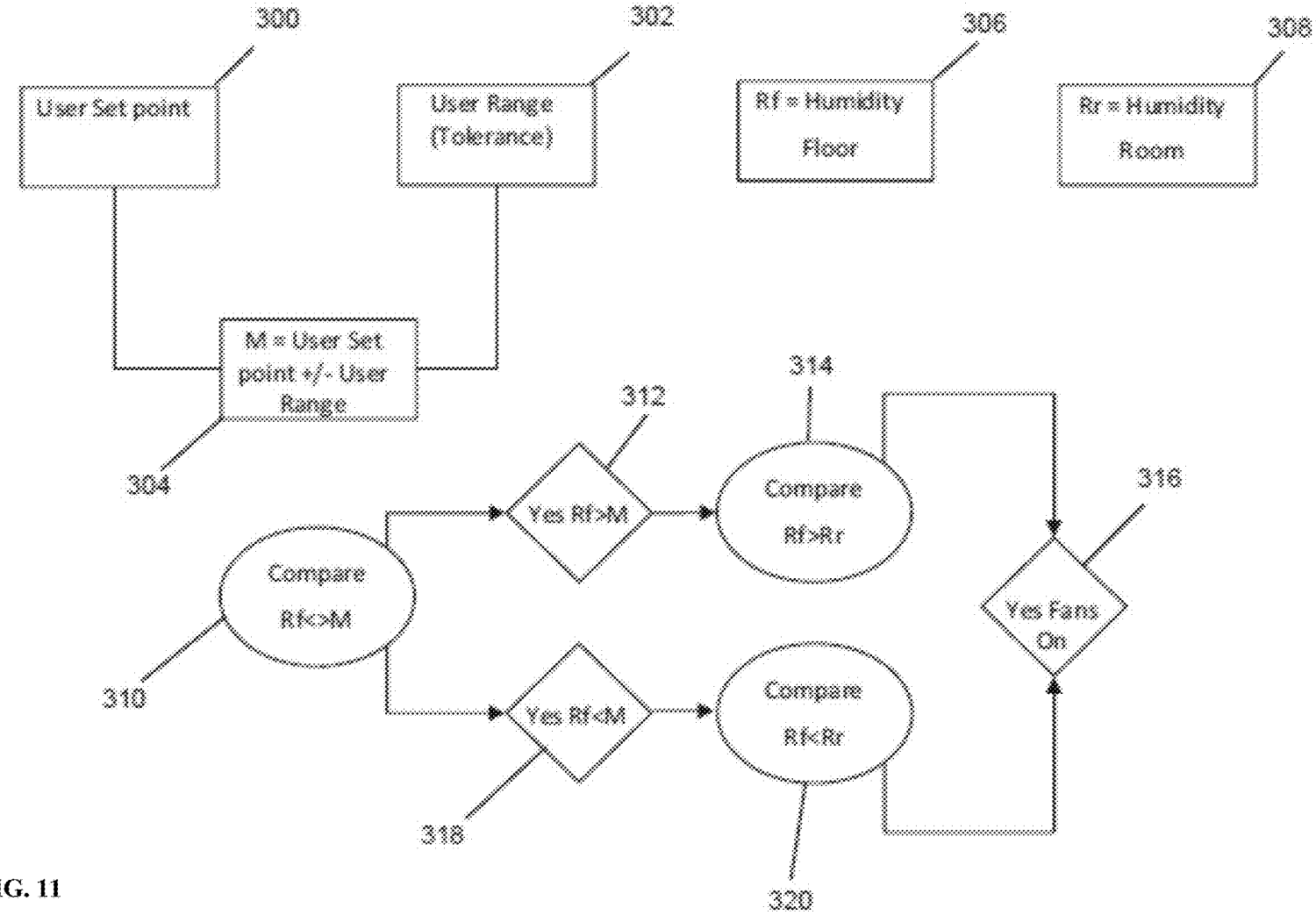
FIG. 11 is a flow diagram depicting example control logic used in the disclosed flooring system.

With reference now to FIG. 11, the control box 114 selectively activates the air movers 116 according to the following example control logic with respect to humidity. It should be understood that even though this disclosure describes the control box 114 as being the device that selectively activates the air movers 116, it may in fact be one or more components of the control box 114 (e.g., the computing device) that selectively activate the air movers 116. Nonetheless, a user or person who is in charge of the ventilated athletic flooring system 100 may identify a set point 300 in terms of percentage humidity (e.g., 50% humidity) to serve as a target property for air present in the labyrinth of voids in the substructure 106 of the athletic floor 118. Likewise, the user may define a tolerance 302 (e.g., plus or minus 10%) for the set point 300. By defining the set point 300 and the tolerance 302, the control box 114 will not activate the air movers 116 when the humidity of the air within the labyrinth of voids is within an acceptable range M (e.g., 40%-60% humidity), as represented at 304. As also shown in FIG. 11, the humidity of air within the athletic floor 118 is abbreviated Rf, as represented at 306, and the humidity of air within the room from which the air movers 116 are drawing air is abbreviated Rr, as represented at 308.

It should further be understood that the ventilated athletic flooring system 100 may be programmed with default control logic, which in some examples may involve control logic that is typical based on a venue's altitude, climate, etc. Therefore, those in charge of the athletic flooring system 100 need not necessarily enter any particular settings. Although 40%-60% humidity is used in the example above, those skilled in the art will appreciate that in many contexts an ideal level of humidity for athletic floors exists between 35%-50% humidity.

Based on the control logic, measurements from the sensors 110, 112, and/or user input from an individual in charge of the ventilated athletic flooring system 100, the control box 114 may determine when the air movers 116 should be activated and deactivated. As represented by the example in FIG. 11, the control box 114 may first compare the humidity of the air in the athletic floor Rf to the acceptable range M, as represented at 310. If the humidity of the air in the athletic floor Rf is greater than the acceptable range M, as represented at step 312, the control box 114 may then compare the humidity of the air in the athletic floor Rf to the humidity of the air within the room Rr, as represented at step 314. Thus, if the humidity of the air in the athletic floor Rf is greater than the acceptable range M and is greater than the humidity of the air within the room Rr, then the control box 114 may send a signal to the air movers 116 to activate, as represented at step 316. On the other hand, if the humidity of the air in the athletic floor Rf is less than the acceptable range M, as represented at step 318, the control box 114 may then compare the humidity of the air in the athletic floor Rf to the humidity of the air within the room Rr, as represented at step 320. And therefore, if the humidity of the air in the athletic floor Rf is less than the acceptable range M and is less than the humidity of the air within the room Rr, then the control box may send a signal to the air movers to activate, as represented at step 316.

Although not shown by way of feedback loops, in conditions where the air movers 116 are not activated, the control box 114 may continue comparing the humidity of the air in the athletic floor Rf with the acceptable range M, as represented at 310. For example, if the acceptable range M is 40%-60% humidity, the humidity of the air in the athletic floor Rf is 70%, and the humidity of the air in the room Rr is 80%, then the control box 114 would maintain the air movers 116 in a deactivated state. This follows because the humidity of the air in the athletic floor Rf is closer to the acceptable range M than the humidity of the air in the room Rr. In turn, the control box 114 may continue to compare the humidity of the air in the athletic floor Rf to the acceptable range M continuously or periodically. Moreover, even while the air movers 116 are activated, the control box 114 may be comparing the humidity of the air in the athletic floor Rf to the acceptable range M so the control box 114 knows when to deactivate the air movers 116.

The above examples represent approximately the simplest form of control logic of the control box 114. For instance, the control box 114 may consider other properties of air quality, such as carbon dioxide content, temperature, and the like. The control logic in some examples may use complicated formulas to assess whether or not to activate one or more of the air movers 116. For example and without limitation, if routing the ambient air in the room into the athletic floor 118 would only slightly improve the level of humidity within the athletic floor 118 but would considerably degrade the temperature and carbon dioxide levels within the athletic floor 118, the control logic may dictate that the control box 114 not activate the air movers 118—even though at least some of the properties of air are dependent on one another. In still another example, the control logic may value properties of air quality differently. For instance, maintaining a target humidity within the athletic floor 118 may be approximately twice as important, for example only, as maintaining target temperatures or carbon dioxide levels.

In still other examples where the ventilated athletic flooring system 100 only includes one sensor, however, which is disposed within the substructure 106, the control logic may involve comparing only the humidity of air within the substructure 106 to a predetermined level such as 35% to 50% humidity, for example and without limitation. The air movers 116 may be activated when the humidity within the substructure 106 deviates from this acceptable range.

Still other rules, which those in charge of the ventilated athletic flooring system 100 can control, may also be configured as part of the control logic. By way of example, the control logic may include a rule that if one or more air movers 116 has been running for at least four hours and the humidity of the air within the athletic floor 118 has changed by less than 2%, the air movers 116 may be deactivated for several hours. In other words, the air movers 116 may be deactivated where the humidity within the substructure 106 is not increasing or decreasing at a predetermined rate. In this example, the ambient air may be so close in terms of humidity to the air within the athletic floor that the air movers 116 are consuming more energy than the minimal benefit provided to the athletic floor 118. As a further example, the control logic may be programmed to receive and consider weather forecasts. With respect to energy savings, the control logic may include optimization rules such that the control box 114 will wait to activate the air movers 116 until an imminent drop in humidity arrives. To reiterate, these are merely examples, and those having ordinary skill in the art will recognize the advantages of such rules.

In yet a further example, the control box 114 may use such control logic associated with each air mover 116. If each air mover 116 is associated with at least one sensor 110 within the athletic floor 118 and at least one sensor 112 near an intake of the air mover 116, each air mover 116 may be selectively activated independent of the other air movers 116. The ability to control air movers 116 independently of one another may be particularly advantageous for large athletic floors 118 where conditions within the athletic floor 118 are likely to vary from one location to another.

There are multiple ways to monitor the ventilated athletic flooring system 100 and adjust the system settings through user input. For example, as disclosed above, the control box 114 can be connected to the venue's local area network, wide area network, system control center, etc. and monitored and adjusted remotely. Likewise, because the control box 114 may be connected to the Internet or the World Wide Web, the ventilated athletic flooring system 100 can also be monitored remote from the venue. For instance, personnel from the venue could monitor the ventilated athletic flooring system 100 remotely from a personal computer (PC) at home, a mobile phone application, or the like. The venue could also subscribe to a service through which a third party monitors the air quality, statistics associated with air quality trends, and the like. In effect, this capability to monitor the system 100 remotely would allow anyone provided with proper security credentials to log into an online interface and monitor the system 100.

Figure 12:
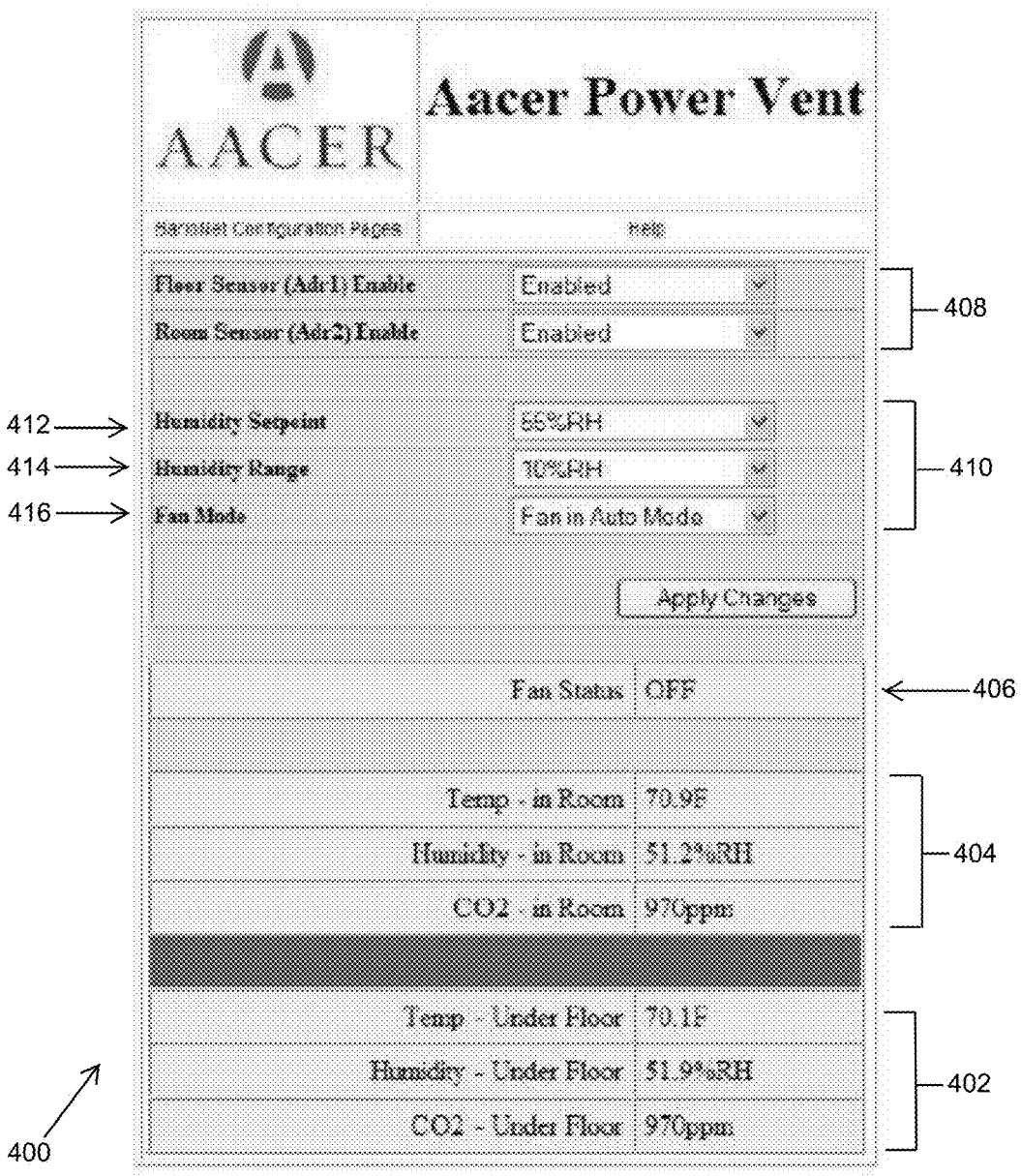
FIG. 12 is a partial view of an online interface that can be used to monitor the disclosed flooring system.

A portion of an example online interface 400 can be seen in FIG. 12. In this particular example interface, data 402 from a sensor underneath the floor is shown along with data 404 from a sensor in the room from which the air mover draws in air. An air mover status 406 is also shown. Still further, options 408 to enable or disable the sensors are shown, in addition to drop down bars 410 that allow a user to modify a set point for humidity 412, a tolerance for humidity 414, and a mode 416 in which the air mover should operate.

In some examples, the air movers 116 may be connected to a venue's heating, ventilation, and air-conditioning (HVAC) system. The air quality of air output from an HVAC system is typically ideal, or at least close to ideal, for air that should be circulated through the athletic floor 118. Part of the reason that HVAC systems output air having ideal properties is because many HVAC systems incorporate dehumidifiers and/or humidifiers. By connecting the air movers 116 to the HVAC system, the air movers 116 can route air that is output from the HVAC system to the labyrinth of voids within the athletic floor 118. Further, at least one of the sensors 112 may be located so as to measure properties of air that originates from the HVAC system.

In still other examples, the ventilated athletic flooring system 100 may include one or more alarms. The alarms may be, for example only, blinking LEDs at the control box 114; sirens that sound in the venue; or text messages, phone calls, alerts (e.g., on mobile phone applications), and/or emails that are sent to those in charge of the ventilated athletic flooring system 100, a fire department, an insurance agency, etc.; and/or any combination thereof. The alarm may provide notice to those in charge of the system 100 when humidity, carbon dioxide content, and/or temperature within the substructure 106 exceed or fall below a predetermined level or levels, as measured by the sensors 110, which send measurements to the control box 114. This level does not necessarily coincide with the acceptable range discussed above, as those in charge would not necessarily need to be notified at every occasion on which one of these properties of air quality within the substructure 106 strays from one or more of the acceptable ranges. Instead, at least in some examples, the alarm may be reserved for more dire situations, such as where the humidity in the substructure 106 has remained at over 90% for more than several hours, for instance, or where the smoke is detected in the substructure 106. Still further, however, the alarm may also be used to notify those in charge of a problem with the system 100 such as when a component of the system 100 malfunctions. By way of example, the alarm may provide notice where the air mover 116 is not responding to a command from the control box 116 to activate or deactivate, or where a sensor 110, 112 is providing faulty readings.

One example method of installing the ventilated athletic system 100 involves locating a wall at which the control box 114, one or more air movers 116, and external sensor 112 will be located. The next step, at least in examples where the sensors 110, 112 are wired rather than wireless, is to lay wire for at least one sensor 110 that will be located within the substructure 106 of the athletic floor 118. The wire ideally allows the sensor 110 to be located at least sixty percent of a width of the floor 118 away from the wall that supports the control box 114 and the air mover 116. The other end of the wire may be routed to the control box 114. The substructure 106 may then be installed and, once the athletic floor 118 is in place, the air mover 116 can be installed. The wiring can then be run from the air mover 116 to the control box 114. Another sensor 112 can also be mounted on the wall. Ideally, the sensor 112 measuring ambient air is located between three and ten feet from the athletic floor 118 to properly measure the air quality of the building. Once mounted, this sensor 112 too can be wired to the control box 114. It should be understood that these steps can be performed in a variety of sequences.

Although certain example systems and methods have been described herein, the scope of coverage of this patent is not limited thereto. To the contrary, this patent covers all systems, methods, apparatus, and articles of manufacture fairly falling within the scope of the appended claims either literally or under the doctrine of equivalents.

I claim:

1. A ventilated flooring system comprising:
- a substructure having a plurality of voids;
- a base that supports the substructure;
- a top surface that is supported by the substructure;
- a first sensor disposed within the plurality of voids, the first sensor for measuring at least one property of air within the plurality of voids;
- a second sensor external to the substructure, the second sensor for measuring at least one property of air external to the substructure;
- at least one air mover that is selectively activated to circulate air through the plurality of voids; and
- a control box that selectively activates the at least one air mover based at least on control logic and measurements of the first and second sensors.

2. A ventilated flooring system as recited in claim 1, wherein settings associated with the ventilated flooring system are controllable via an online interface.

3. A ventilated flooring system as recited in claim 1, wherein the control logic compares measurements from the first sensor to measurements from the second sensor.

4. A ventilated flooring system as recited in claim 1, wherein the substructure comprises a first subfloor and a second subfloor, with the first subfloor supporting the second subfloor, with the second subfloor supporting the top surface, wherein boards of the second subfloor are either perpendicular to or at an angle to boards of the top surface, wherein boards of the first subfloor and the boards of the second subfloor create the plurality of voids.

5. A ventilated flooring system as recited in claim 1, further comprising an alarm that provides notice when at least one of humidity, carbon dioxide content, or temperature within the plurality of voids exceeds a predetermined level.

6. A ventilated flooring system as recited in claim 1, further comprising:

a third sensor for measuring at least one property of air within the plurality of voids; and a fourth sensor for measuring at least one property of air external to the substructure;

wherein the at least one air mover comprises a first air mover and a second air mover, wherein the control box activates the first air mover based on the control logic and measurements from the first and second sensors, the control box activating the second air mover based on the control logic and measurements from the third and fourth sensors.

7. A ventilated flooring system as recited in claim 6, wherein each of the first, second, third, and fourth sensors measure two or more of humidity, temperature, or carbon dioxide content of air.

8. A ventilated flooring system as recited in claim 1, wherein the control box selectively activates the at least one air mover based on the control logic, the measurements of the first and second sensors, and user input.

9. A ventilated flooring system as recited in claim 8, wherein the user input comprises specifying a target level of at least one of humidity, temperature, or carbon dioxide content of air.

10. A ventilated flooring system as recited in claim 1, wherein the at least one air mover is connected to an HVAC system and the at least one air mover directs air from the HVAC system into the plurality of voids.

11. A ventilated flooring system as recited in claim 10, wherein the second sensor measures the at least one property of air originating from the HVAC system.

12. A ventilated flooring system comprising:

a substructure having a labyrinth of voids;

a base that supports the substructure;

a top surface that is supported by the substructure;

a first sensor disposed within the labyrinth of voids, the first sensor for measuring at least one property of air with in the labyrinth of voids;

at least one air mover that is selectively activated to circulate air through the labyrinth of voids; and a control box that selectively activates the at least one air mover based at least on control logic and measurements of the first sensor, wherein the control box comprises a computing device, wherein settings associated with the ventilated flooring system are controllable via an online interface.

13. A ventilated flooring system as recited in claim 12, further comprising a second sensor that measures at least one property of ambient air, wherein the control logic compares measurements from the first sensor and the second sensor in assessing whether to activate and deactivate the at least one air mover.

14. A ventilated flooring system as recited in claim 12, further comprising an alarm that provides notice when at least one of humidity, carbon dioxide content, or temperature within the labyrinth of voids exceeds a predetermined level.

15. A ventilated flooring system as recited in claim 12, wherein the at least one air mover is connected to an HVAC system and directs air from the HVAC system into the labyrinth of voids.

16. A ventilated flooring system as recited in claim 12, further comprising an alarm that provides notice when a component of the flooring system is malfunctioning, wherein the at least one air mover is connected to an HVAC system and directs air from the HVAC system into the labyrinth of voids.

17. A ventilated flooring system comprising:

a substructure having spaces;

a base that supports the substructure;

a top surface that is supported by the substructure;

a sensor disposed within at least one of the spaces, the sensor for measuring at least one property of air within the spaces;

at least one air mover that is selectively activated to circulate air from an HVAC system through the spaces; and a control box that selectively activates the at least one air mover based at least on control logic and measurements of the sensor.

18. A ventilated flooring system as recited in claim 17, wherein settings associated with the ventilated flooring system are controllable via an online interface.

19. A ventilated flooring system as recited in claim 18, further comprising an alarm.

20. A ventilated flooring system as recited in claim 19, wherein the control box deactivates the at least one air mover if the humidity within the substructure is not decreasing at a predetermined rate.

* * * * *